United States Patent [19]

Charron

[11] 4,267,820

[45] May 19, 1981

[54] CONTROL MECHANISM FOR A GAS-FIRED WATER HEATER

[75] Inventor: Jean-Claude Charron, Saint Maur, France

[73] Assignee: Saunier Duval, Rueil Malmaison, France

[21] Appl. No.: 955,254

[22] Filed: Oct. 27, 1978

[30] Foreign Application Priority Data

Oct. 28, 1977 [FR] France ..... 77 32668

[51] Int. Cl.[3] ..... F24H 1/10

[52] U.S. Cl. ..... 126/351; 431/49

[58] Field of Search ..... 126/351; 431/44, 46, 431/49, 50

[56] References Cited

U.S. PATENT DOCUMENTS

| | | | |
|---|---|---|---|
| 2,390,172 | 12/1945 | Ray | 431/44 |
| 2,411,230 | 11/1946 | Ray | 431/44 |
| 2,437,894 | 3/1948 | Ray | 431/44 |
| 2,564,869 | 8/1951 | Weber | 431/46 |
| 2,610,682 | 9/1952 | Weber | 431/46 |
| 2,652,110 | 9/1953 | Main | 431/44 |
| 3,765,452 | 10/1973 | Charron | 137/630.15 |
| 3,815,813 | 6/1974 | Charron | 236/23 |

FOREIGN PATENT DOCUMENTS

| | | | |
|---|---|---|---|
| 1958196 | 8/1970 | Fed. Rep. of Germany | 431/46 |
| 2846916 | 5/1979 | Fed. Rep. of Germany | 431/44 |
| 1366039 | 6/1964 | France | 431/49 |

*Primary Examiner*—Stephen P. Garbe

*Attorney, Agent, or Firm*—Kenway & Jenney

[57] ABSTRACT

A control mechanism for a gas-fired hot water heater, which operates without a permanent burner pilot, has an electrical circuit for selectively operating an igniter in response to gas pressure in the heating system. The water heater has a main chamber for providing gas to the igniter pilot and the burner element, and a secondary chamber for providing gas to a safety pilot. Circuitry responsive to a high gas pressure in the main chamber activates the igniter and circuitry responsive to a high gas pressure in the secondary chamber interrupts operation of the igniter. Continuous operation of the igniter element is thereby prevented, for example, due to a low gas pressure condition.

8 Claims, 4 Drawing Figures

CONTROL MECHANISM FOR A GAS-FIRED WATER HEATER

BACKGROUND OF THE INVENTION

The invention relates generally to safety and control units for gas hot water heaters and in particular to a gas-fired hot water heater which operates without a permanent burner pilot.

Gas-fired water heaters not employing a permanent burner pilot generally use a control and regulation unit between the main gas control valve and the inlet fitting of the gas burner, as described in French Pat. No. 1336039 assigned to the assignee of this application. This control and regulation device consists of a diaphram pressure regulator arranged so that its closure mechanism for the gas flow is located at two positions on either side of the maximum open position. One position corresponds to the diaphram extended position, the other to the relaxed position of the diaphram. The closure mechanism of the regulator and control mechanism is mechanically secured to a second diaphram. This second diaphram has one face permanently exposed to the pressure of outside air. The other side of the second diaphram communicating with a secondary chamber, can be subjected to the gas pressure upstream of the gas control valve through a valve which is controlled by a thermally sensitive device of low inertia. The thermally sensitive device detects the ignition of a first pilot, the igniter pilot, which will normally operate momentarily when gas is first supplied. The secondary chamber, under the face of the second diaphram, is connected to a second pilot, the safety pilot.

It is also known, through the French Patent of Addition No. 96318, filed by the assignee of this application, that one can use a safety mechanism which has a single valve to control both the gas flow to the burner and to the igniter pilot. In one position of the valve, it shuts off the flow of gas to the burner and opens the flow of gas to the igniter pilot. In its other position, the valve opens the flow of the gas to the burner and shuts off the flow of gas to the igniter pilot. The movement of a sliding stem which supports the particular valve illustrated in this patent is mechanically tied to the motion of a diaphragm which has one face in contact with external air pressure. The other face of the diaphragm can be subjected to the gas pressure upstream of the main control valve for the water heater, through a small valve activated by a thermal device of low inertia operating in response to the igniter pilot.

However, these arrangements have several problems. In the referred to embodiments, the gas valve is opened by the introduction of water within the unit which causes the gas control valve to open through a push rod. The rod in turn raises a contact blade which closes the electrical circuit of the igniter. Thus control of the igniter does not depend upon the level of gas pressure in the line. At the same time, the gas flows to the igniter pilot and lights up when it contacts the igniter. This causes the thermal element of a flame detector, located adjacent the flame of the igniter pilot, to heat up.

If for any reason, the gas pressure is below the distribution pressure normally associated with this type of device, the igniter pilot will light up nevertheless and heat up the thermally sensitive element. As a result, the valve associated with the thermally sensitive element opens and provides gas to the safety pilot which then turns on. However, in this case the gas pressure is insufficient to raise the diaphram, and its associated moving equipment, whose function it is to shut down the igniter pilot, to terminate power to the igniter, and to open the burner gas inlet valve. Consequently, the thermal element is consistently heated by the flame of the ignition pilot, and the ignition circuit is permanently energized. This condition can bring about a rather quick deterioration of these two parts.

An object of the invention is therefore a gas-fired hot water heater having a safety ignition circuit in which the energizing and the de-energizing of the igniter are positively controlled directly by the gas pressure so that continuous operation of the igniter cannot occur.

Other objects of the present invention are a gas-fired water heater having an ignition control device which is reliable and safe.

SUMMARY OF THE INVENTION

The invention relates to a gas-fired water heater adapted to operate without a permanent pilot. The water heater features, according to the invention, a main gas inlet chamber for providing gas to an igniter pilot, a secondary gas inlet chamber for providing gas to a safety pilot, an igniter for the igniter pilot, and a flame detector disposed adjacent and responsive to at least the igniter pilot. The water heater further features means responsive to the flame detector for admitting gas into the secondary chamber and an electrical circuit responsive to the pressures of gas in the main and in the secondary chambers for energizing the igniter when sufficient gas pressure exists in the main chamber and for de-energizing the igniter whenever there is at least a minimum pressure in the secondary chamber.

In a particular embodiment of the invention, the igniter pilot, the safety pilot, the igniter, and the flame detector are disposed in an operative relation to each other, and the electrical ignition control circuit has first switch means, having a first and a second state, for energizing in one of its states the igniter when the pressure of gas in the first chamber exceeds a minimum gas pressure, and second switch means having a first and a second state, the second switch being in one of said states for terminating operation of the igniter when the pressure of gas in the second chamber exceeds a second minimum value. The second switch means, in its other state, allows the first switch means to control and, if the pressure is great enough, to energize the igniter.

DESCRIPTION OF THE DRAWINGS

Other objects, features, and advantages of the invention will be better understood from the following description of a preferred embodiment of the invention taken together with the attached drawings in which.

DESCRIPTION OF A PREFERRED EMBODIMENT

Figure 1:
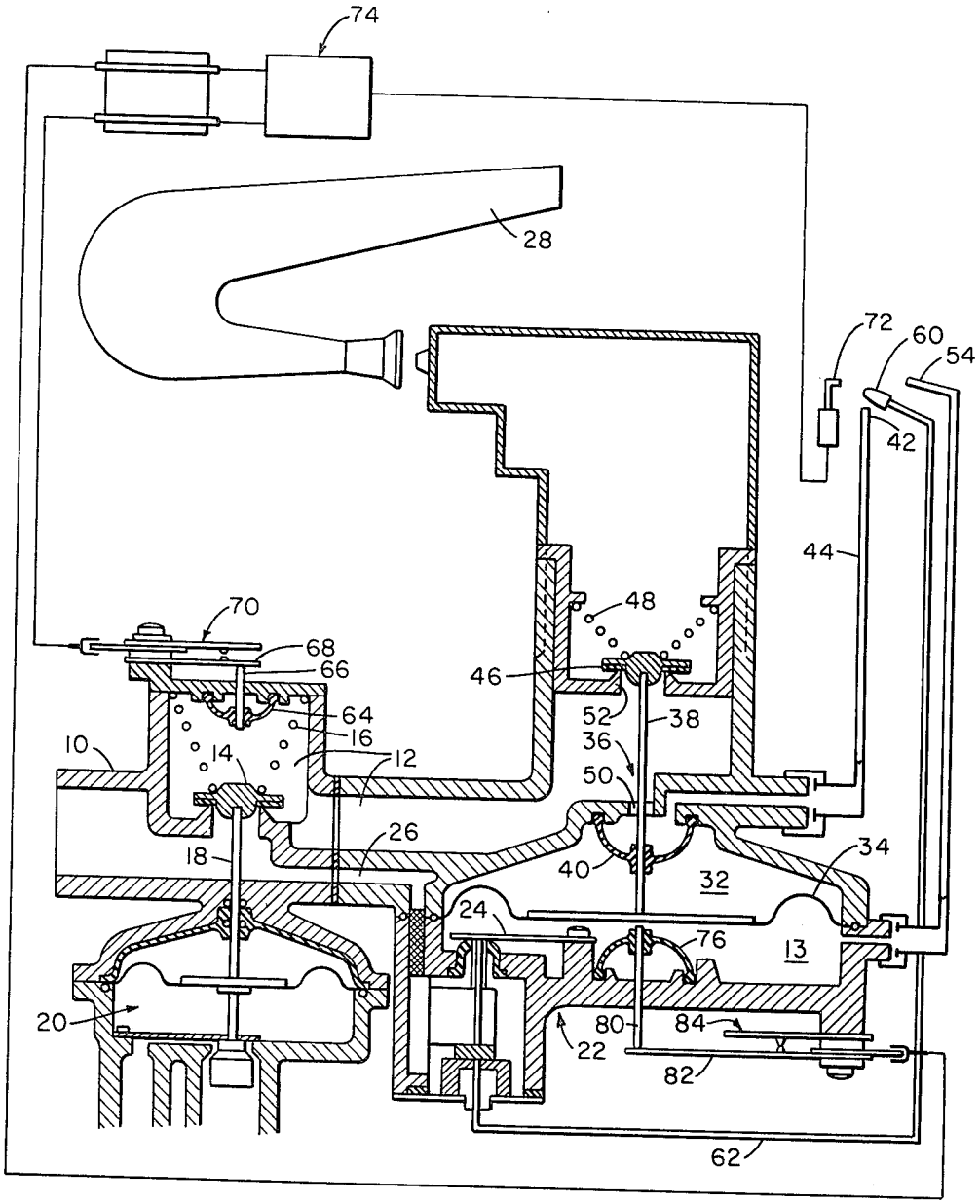
FIG. 1 is a schematic view of the apparatus according to the invention in the rest state.

Referring to FIG. 1, the gas flow to a hot water heater is provided through a gas inlet pipe or conduit 10. The gas heater housing has a main gas chamber 12 and a secondary inlet gas chamber 13. The gas is directed to the main gas chamber 12 through a main control valve member 14, which in the illustrated embodiment has a return spring 16 and a push rod 18 controlled by a standard water valve schematically shown at 20. In the illustrated embodiment, gas is also directed to a control unit 22, and in particular to the secondary inlet chamber 13 through a valve member 24. Valve member 24 is in gaseous communication with inlet conduit 10 through a gas passage 26.

The control unit 22 controls the gas flow to a burner 28 which is located downstream of the main valve 14. The control unit is positioned ahead of the burner, is of cylindrical shape, and is divided into the secondary inlet chamber 13 and a reference pressure chamber 32 by a diaphram 34. A mechanism 36 is connected to and moves with the diaphram 34. The moving mechanism 36 consists of a vertical rod 38, on which a valve 40 is mounted. Valve 40 controls the gas flow to an igniter pilot 42 through a conduit 44. Mechanism 36 also includes a second valve 46 which directly controls the gas flow to burner 28. The entire mechanism is pushed downward by a spring 48. A passage 50 coaxial with rod 38 connects the gas inlet chamber 12 to the conduit 44 and hence to the pilot 42. Valve 40 thus controls the gas flow to pilot 42.

In its lower or bottom position, illustrated valve 46 shuts off the gas flow to burner 28 by resting against its seat 52. Valve 40 is open in this position. In its upper position, valve 40 closes and terminates the flow of gas through conduit 44 to the pilot 42 by closing passage 50. Valve 46 is now open. Valves 46 and 40, in the illustrated embodiment, are mounted in tandem on a common rod (rod 38) and operate in opposition, that is, when one valve is open, the other valve is closed.

Figure 2:
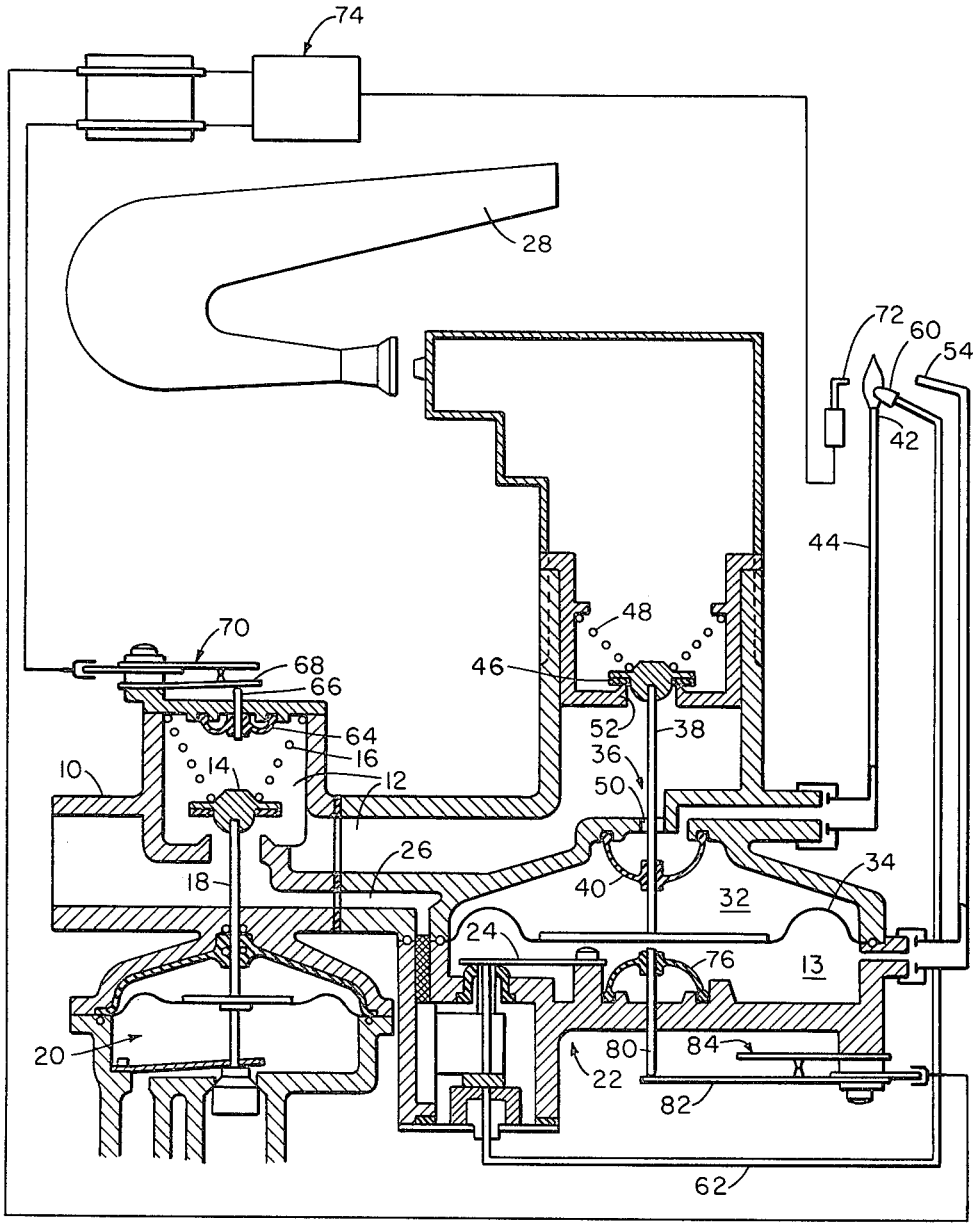
FIG. 2 is a schematic view of the preferred embodiment of the invention during the operation of the igniter pilot.

The high pressure secondary chamber 13 is in gaseous communication with a safety pilot 54. Chamber 13 is connected to the gas inlet conduit 10 through passage 26 and valve 24 as noted above. Valve 24 is itself controlled by a thermally sensitive element of a flame detector mechanism, which can include, for example, a small bulb 60 which has a very low thermal inertia and which is located in the flame of pilot 42. When it expands, it causes, through a tube 62, the opening of the valve 24 (FIG. 2).

A small diaphram 64 is mounted within the main inlet chamber 12, downstream of the main valve 14 and upstream of the igniter pilot 42. This diaphram 64 is attached to a rod 66 which operates an electrical switching element or assembly. In the illustrated embodiment, rod 66 acts on a flexible blade 68 of contacts 70 which thereby cause an igniter 72 to energize through an igniter circuit 74. The igniter 72 is located in front of or adjacent to the flame of the igniter pilot 42. Contacts 70 are open in the rest position, for example when there is no gas pressure in chamber 12.

Another small diaphram 76 is located in the secondary chamber 13, downstream from the valve 24 and upstream of the safety pilot 54. Diaphram 76 is attached to a rod 80 which operates a second electrical switching element or assembly. In the illustrated embodiment, rod 80 acts on a flexible blade 82 of contacts 84. Contacts 84 are closed in the rest (low pressure) position, and terminate power to igniter 72 when the contacts are opened.

The operation of the apparatus will now be described. At rest, (which corresponds to the inlet valves being closed), the main valve 14 is closed because water is not running through the water valve of the unit. The moving part of the main valve control mechanism is then located in the lower operating position in which gas cannot enter chamber 12. Valve 24 is therefore also closed because there is no thermal excitation at bulb 60.

As soon as the water valve 20 is opened (FIGS. 2 and 3), by the passage of water through the water valve, valve 14 rises and opens. The resulting gas pressure in the inlet chamber 12 acts on the small diaphram 64 which causes the displacement of rod 66 and hence of the flexible blade 68. This action closes contacts 70 which in turn energizes igniter 72.

At the same time, the gas reaches pilot 42 through the opening 50 and conduit 44, and ignites when it contacts the igniter. Gas cannot however reach the burner because valve 46 remains closed, in position on its seat 52.

Figure 3:
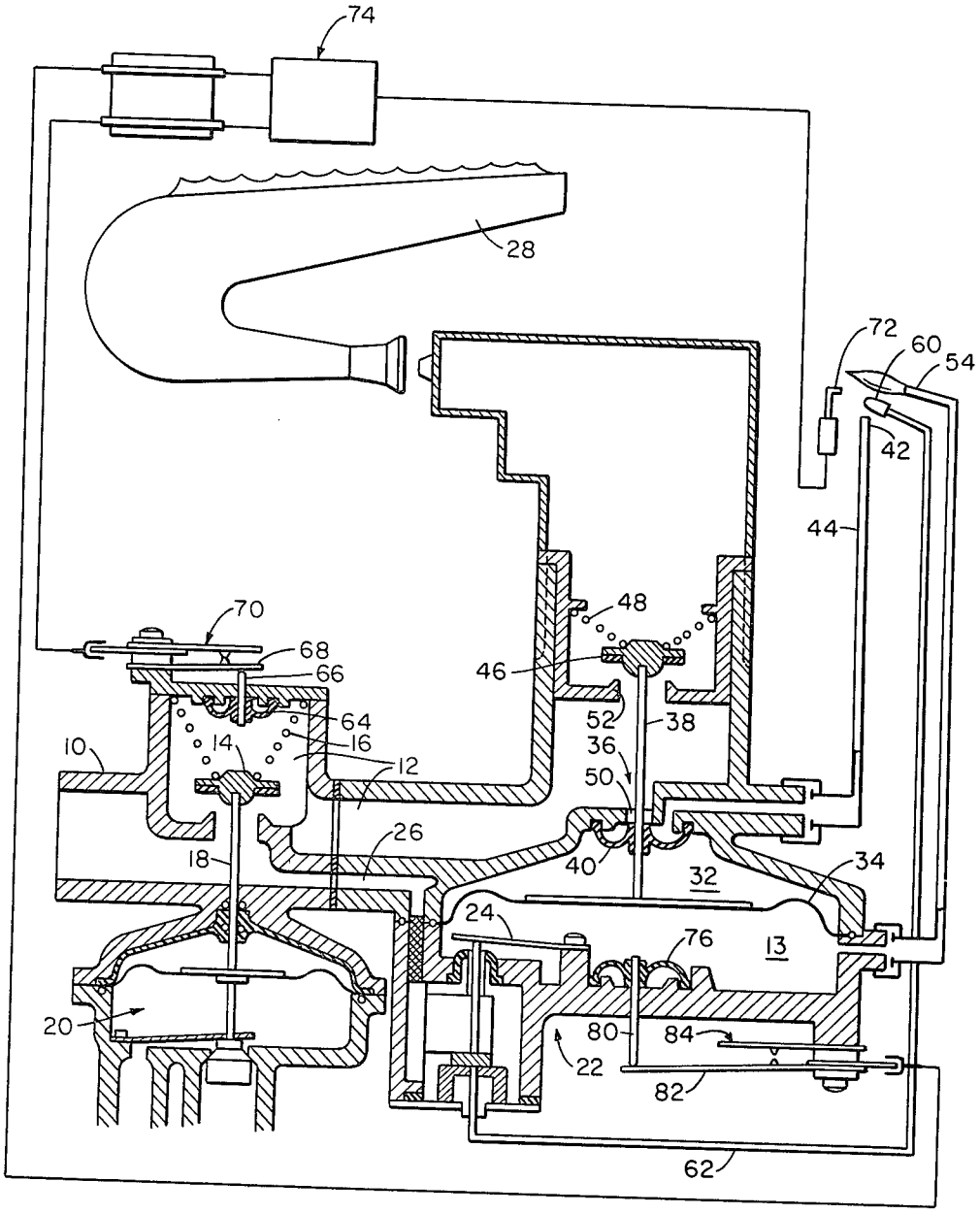
FIG. 3 is a schematic view of the preferred embodiment of the invention during the operation of the burner.

Referring now to FIG. 3, after a brief time delay, the expansion of the air within bulb 60, caused by the heat from pilot 42, is sufficient to open the small valve 24. Gas originating upstream of the main valve 14 now also passes through conduit 26 and enters into secondary chamber 13. This provides gas flow to the safety pilot 54, which in turn lights up when the gas contacts the flame of the igniter pilot 42.

As soon as the gas enters chamber 13, diaphram 34 moves up and causes, through the intermediary of rod 38, first the opening of valve 46 to allow the gas flow to burner 28 and subsequently the closure of the valve 40. Also, the igniter pilot 42 turns off. At the same time, the pressure of the gas in chamber 13 acts against diaphram 76. This causes the displacement of rod 80 and of the flexible blade 82; and thus contacts 84 open and igniter 72 is no longer energized.

The heating unit now operates and the burner remains on as long as the water valve remains open.

If for any reason, the gas pressure falls below its normal operating pressure while the water valve 20 keeps main valve 14 open, the gas pressure within the main inlet chamber 12 will not be sufficient to raise diaphram 64 and thus contacts 70 open (or do not close) and the igniter 72 is deenergized (or not energized).

In addition, with this apparatus, if the safety pilot 54 is extinguished during the operation of the burner, valve 46 shuts off immediately and the valve 40 opens up to energize the igniter pilot 42. At the same time, the gas pressure no longer acts against the small diaphram 76 and contacts 84 close and igniter 72 is energized again causing the igniter pilot 42 to ignite. The starting cycle then begins again.

Thus this mechanism has the advantage of preventing operation of the igniter when the gas pressure is lower than required and insures increased safety during the operation of the unit.

Figure 4:
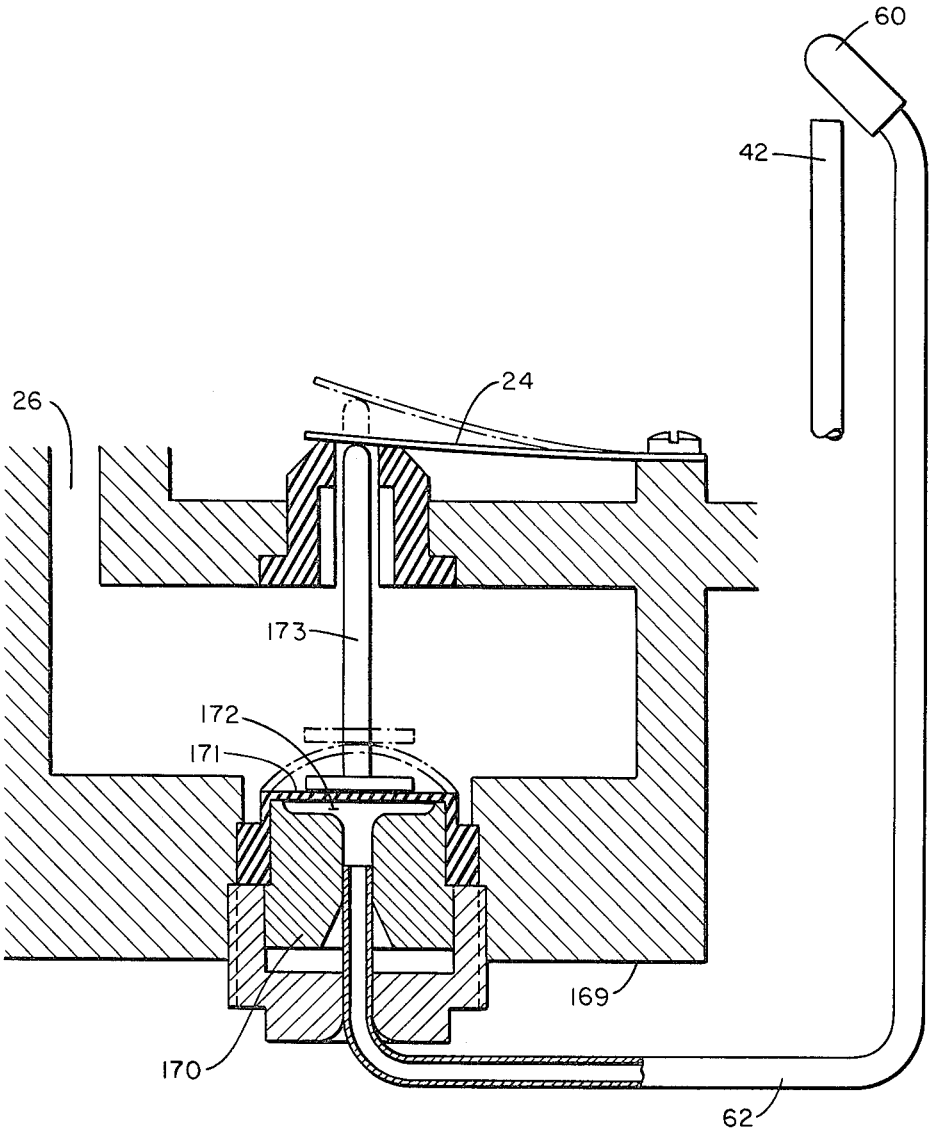
FIG. 4 is a view in cross section through the mechanism for operating the valve 24 which is shown only schematically in FIGS. 1–3.

Although those skilled in the art will recognize that there are obviously several mechanisms which could be employed to operate the valve 24, there is shown in FIG. 4 a preferred version. The end of the tube 62 opposite the bulb 60 terminates in the valve housing 169, in a chamber 172 formed between two pieces of rubber 170 and 171. The piece 171 is relatively thin and flexible and rests against a disc secured to the lower end of the rod 173, the upper end of which bears against the lower surface of a flexible closure member 24. When the bulb is heated, the air in it and the tube 62 expands to cause the rubber piece 171 to flex upwardly and cause the rod 173 to open the valve 24.

Additions, subtractions, deletions, and other modifications of the preferred embodiment of the invention will be obvious to those skilled in the art and are within the scope of the following claims.

What is claimed is:

1. A gas-fired hot water heater adapted to operate without a permanent pilot comprising an igniter pilot, a main gas inlet chamber for providing gas to said igniter pilot, a safety pilot, a secondary gas inlet chamber for providing gas to said safety pilot, an igniter for said igniter pilot, a flame detector disposed adjacent and responsive to at least the igniter pilot, means responsive to said flame detector for admitting gas into said secondary chamber, and switching means responsive to the pressures of gas in said main chamber and said secondary chamber for energizing said igniter when sufficient gas pressure exists in said main chamber and for deenergizing said igniter whenever there is at least a minimum pressure in said secondary chamber.

2. A gas-fired hot water heater adapted to operate without a permanent pilot light comprising a first gas inlet chamber, a second gas inlet chamber, an inlet conduit for supplying said first and second inlet chambers through first and second supply control elements respectively, a burner in gaseous communication with the first chamber, an igniter element, an igniter pilot disposed in operative relation to said igniter element and in gaseous communication with said first chamber, a safety pilot in operative relation to said igniter pilot and in gaseous communication with said second chamber, a flame detector responsive to a flame from either of said pilots, means for controlling gas flow to said second inlet chamber in response to said flame detector, a circuit for energizing said igniter element, said circuit including first switch means having a first and a second state for energizing in one said state said igniter when the pressure of gas in said first chamber exceeds a minimum gas pressure and to interrupt energy to the igniter in said other state when the pressure in the first chamber is low, second switch means having a first and a second state, said switch being in said first state for terminating operation of said igniter when the pressure of gas in said second chamber exceeds a minimum value, wherein in the second state said second switch means allows said first switch means to energize said igniter.

3. A control device for a gas-fired hot water heater adapted to operate without a permanent pilot light comprising a first gas inlet path for providing gas to a first gas inlet chamber, a first valve disposed in said inlet path upstream from said first inlet chamber for controlling the flow of gas to said first chamber, a second gas inlet path for providing gas to a second gas inlet chamber, a second valve disposed in said second inlet path for controlling the flow of gas to said second chamber, an igniter, an igniter pilot adjacent said igniter, a safety pilot disposed adjacent said igniter pilot and in gaseous communication with said second chamber, a burner, a third valve for providing gaseous communication between said burner and said first gas inlet chamber, a fourth valve for providing gaseous communication between said igniter pilot and said first gas inlet chamber, a water conduit, a fifth valve in fluid communication with said water conduit and communicating with said first valve for operating said first valve to an open position when the pressure of the water in said conduit exceeds a selected value, a low inertia thermally responsive element operationally positioned adjacent said igniter pilot and said safety pilot, means for operating said second valve in response to said thermally responsive element for admitting gas into said second inlet chamber, a first electrical switching means for energizing said igniter in response to a first minimum level of gas pressure in said first inlet chamber, and a second electrical switching means for interrupting power to said igniter in response to a second selected level of gas pressure in said second inlet chamber.

4. The control device of claim 3 wherein said first electrical means comprises a diaphram valve element positioned downstream of the first valve within the first gas inlet chamber and upstream of said igniter pilot, an electrical contact member assembly, and means connecting said diaphram element and said electrical contact assembly for providing a change of electrical state of said contact assembly in response to a gas pressure in said first inlet chamber.

5. The control device of claim 4 wherein said contact assembly is in the open state in the absence of pressure in said first inlet chamber.

6. The control device of claim 3 wherein said second electrical switching means comprises a diaphram valve element positioned in said second gas inlet chamber downstream of said second valve and upstream of said safety pilot, an electrical contact member assembly, and means connecting said diaphram element and said electrical contact assembly for providing a change of electrical state of said contact assembly in response to gas pressure in said second inlet chamber.

7. The control device of claim 6 wherein said contact assembly is in the closed state in the absence of pressure in said second inlet chamber.

8. The control device of claim 3 wherein said first electrical switching means further deenergizes said igniter when the pressure in said first inlet chamber is low.

* * * * *